US006158956A

United States Patent [19]

Arnold

[11] Patent Number: 6,158,956

[45] Date of Patent: Dec. 12, 2000

[54] ACTUATING MECHANISM FOR SLIDING VANE VARIABLE GEOMETRY TURBINE

[75] Inventor: Steven Don Arnold, Rancho Palos Verdes, Calif.

[73] Assignee: Allied Signal Inc., Morristown, N.J.

[21] Appl. No.: 09/400,777

[22] Filed: Sep. 22, 1999

Related U.S. Application Data

[60] Provisional application No. 60/103,027, Oct. 5, 1998.

[51] Int. Cl.[7] ..... F01D 17/14

[52] U.S. Cl. ..... 415/158; 415/166

[58] Field of Search ..... 415/150, 157, 415/158, 159, 165, 166; 60/602

[56] References Cited

U.S. PATENT DOCUMENTS 4,499,732 2/1985 Szczupak et al. ..... 60/602
4,586,336 5/1986 Horler ..... 60/602
4,984,965 1/1991 McKean ..... 415/155
5,214,920 6/1993 Leavesley ..... 60/602

*Primary Examiner*—F. Daniel Lopez
*Assistant Examiner*—Liam McDowell
*Attorney, Agent, or Firm*—Grant T. Langton; Felix L. Fischer

[57] ABSTRACT

A variable geometry system for a turbocharger includes a sliding piston disposed within a turbine housing between a primary exhaust gas volute and turbine blades. The sliding piston is axially displaceable within the turbine housing to increase or decrease the volumetric flowrate of exhaust gas to the turbine. The sliding piston is positioned by an actuator having reciprocating movement translated through a rotating sleeve with a first pin engaging a helical slot for axial motion of the piston and a second pin engaging an alignment slot for maintaining axial alignment of the piston.

2 Claims, 2 Drawing Sheets

ACTUATING MECHANISM FOR SLIDING VANE VARIABLE GEOMETRY TURBINE

CROSS REFERENCE TO RELATED APPLICATIONS

This application claims the priority of application Ser. No. 60/103,027 filed on Oct. 5, 1998 having the title Actuating Mechanism For Sliding Vane Variable Nozzle Turbine.

FIELD OF THE INVENTION

This invention relates generally to an exhaust-gas turbocharger and, more particularly, to a slidable piston and actuating mechanism used in a variable nozzle turbine.

BACKGROUND OF THE INVENTION

Turbochargers for gasoline and diesel internal combustion engines are known devices used in the art for pressurizing or boosting the intake air stream, routed to a combustion chamber of the engine, by using the heat and volumetric flow of exhaust gas exiting the engine. Specifically, the exhaust gas exiting the engine is routed into a turbine housing of a turbocharger in a manner that causes an exhaust gas-driven turbine to spin within the housing. The exhaust gas-driven turbine is mounted onto one end of a shaft that is common to a radial air compressor mounted onto an opposite end of the shaft. Thus, rotary action of the turbine also causes the air compressor to spin within a compressor housing of the turbocharger that is separate from the exhaust housing. The spinning action of the air compressor causes intake air to enter the compressor housing and be pressurized or boosted a desired amount before it is mixed with fuel and combusted within the engine combustion chamber.

The amount by which the intake air is boosted or pressurized is controlled by regulating the amount of exhaust gas that is passed through the turbine housing by a wastegate and/or by selectively opening or closing an exhaust gas channel or passage to the turbine running through the turbine housing. Turbochargers that are constructed having such adjustable exhaust gas channel are referred to in industry as variable geometry turbines (VGTs). VGTs typically include a movable member that is positioned within a turbine housing between the exhaust gas source and the turbine. The movable member is activatable from outside of the turbine housing by suitable actuating mechanism to increase or decrease the volumetric flowrate of exhaust gas to the turbine as called for by the current engine operating conditions. Increasing or decreasing the volumetric flowrate of exhaust gas to the turbine respectively increases or decreases the intake air boost pressure generated by the compressor mounted on the opposite end of the turbine shaft.

U.S. Pat. No. 3,478,955 discloses a variable area diffuser for a compressor comprising a movable wall that is positioned within the compressor case and that is axially displaceable therein to move against an adjacent case wall. Moving the movable wall towards the adjacent case wall operates to decrease the volumetric flowrate of gas from the case discharge chamber to an impeller, thereby reducing the impeller's rotational speed. The movable wall is in the form of an annular ring that is disposed concentrically around the impeller and that is positioned within an annular groove in an axially facing surface of the case. Axial displacement of the movable wall within the case is controlled by a complex arrangement of posts that extend through the case, that are attached at one end to the movable wall, and that are attached at an opposite end to an actuating mechanism. The actuating mechanism includes a rotary control ring that is adapted to cause axial movement of the posts and attach movable wall by rotary control ring movement around the compressor case.

A concern of such design is the use of a complex actuating mechanism that could be prone to operating problems or failure. An additional concern is the need to use numerous sealing components to prevent the passage of exhaust gas through the case between the moveable wall and actuating posts.

U.S. Pat. No. 4,886,416 discloses an exhaust gas turbocharger comprising a sliding sleeve positioned within a turbine housing between the exhaust gas source and the turbine. The sliding sleeve is adapted to both rotate and move axially within the turbine housing to increase or decrease the volumetric flowrate of exhaust gas to the turbine. The sliding sleeve is operated by a driving ring that is rotatably mounted within the housing adjacent the sliding sleeve, and that is put into rotational operation by gear interaction with a rotary actuating lever. The sliding sleeve includes a axial slot and a helical slot in its surface that cooperates with a respective driving pin (projecting, from the rotatable driving ring) and a slot pin (projecting from the fixed housing). The sliding sleeve is both rotated and moved axially within the turbine housing by rotation of the driving ring, which in turn causes the driving pin to engage the sliding sleeve axial slot and effect axial/rotational movement via engagement of the sliding sleeve helical slot and slot pin.

In an effort to simplify the operation of VGTs, and optimize efficient operation of the same, it is desired that a VGT be constructed having an exhaust gas flow path adjustment mechanism configured to provide such adjustment in a simple manner within a turbine housing. Is it desired that the adjustment mechanism be configured to permit actuation using a simplified actuating mechanism having minimum number of moving parts.

SUMMARY OF THE INVENTION

A VGT, constructed according to principles of this invention, includes a sliding piston disposed within a turbocharger turbine housing between a primary exhaust gas volute and turbocharger turbine blades. The sliding piston is axially displaceable within the turbine housing to increase or decrease the volumetric flowrate of exhaust gas to the turbine, thereby respectively increasing or decreasing the rotary speed of an air compressor, attached to the turbine via a common shaft, and increasing or decreasing the boost pressure of intake air provided by the air compressor. Alternatively the exhaust back pressure of the engine is controlled by modulating piston position. The sliding piston is positioned by an actuator configured to operate the sliding piston by simple reciprocating movement.

BRIEF DESCRIPTION OF THE DRAWINGS

The details and features of the present invention will be more clearly understood with respect to the detailed description and the following drawings.

DETAILED DESCRIPTION OF THE INVENTION

Figure 1:
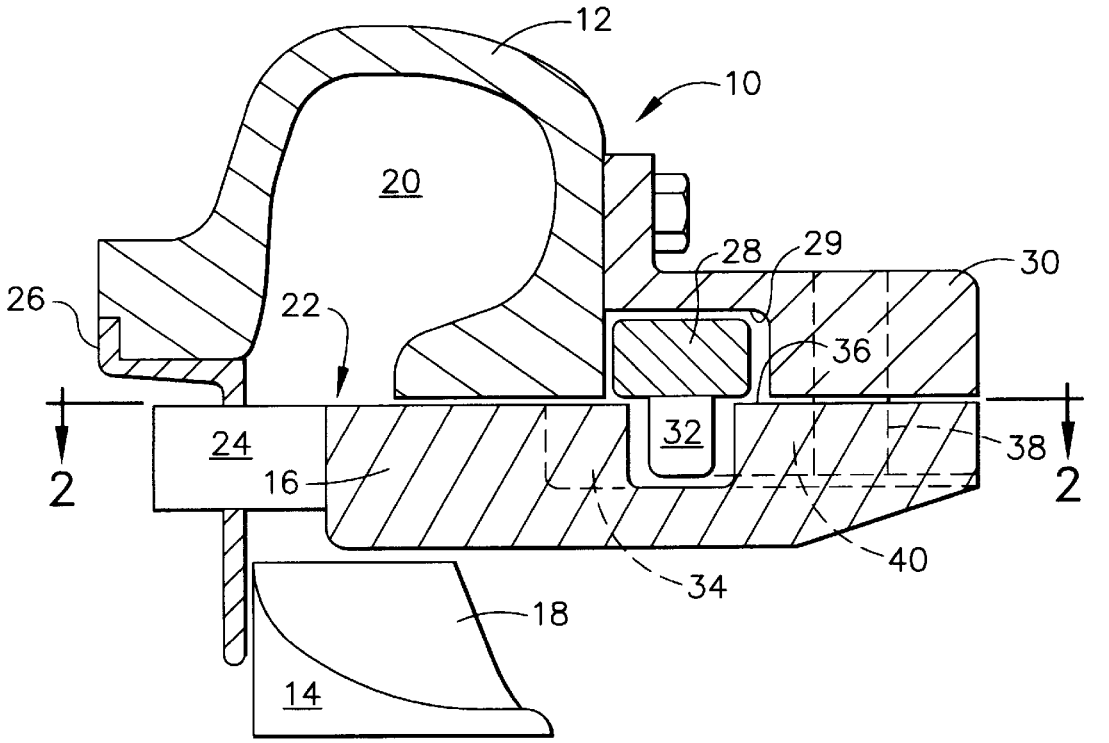
FIG. 1 is a cross-sectional side partial view of a variable nozzle turbine constructed according to principles of this invention comprising a slidable piston.

Referring to FIG. 1, a VGT 10 comprises an exhaust-gas housing 12 adapted to receive and exhaust gas from an internal combustion engine and distribute the same to an exhaust gas turbine wheel 14 rotatably disposed within the housing 12. A sliding annular piston 16 is disposed concentrically within the housing and is axially displaceable therein. The piston 16 is positioned concentrically within the housing 12 between turbine wheel blades 18 and a turbine housing exhaust-gas volute 20. The piston 16 is axially slidable within the housing 12 to move within an exhaust-gas channel 22 disposed between the turbine wheel blades 18 and the exhaust-gas volute 20. The piston 16 can be moved axially within the housing 12 towards and away from vanes 24 that are positioned within a perforated heat shield 26 disposed within the turbine housing.

Figure 2:
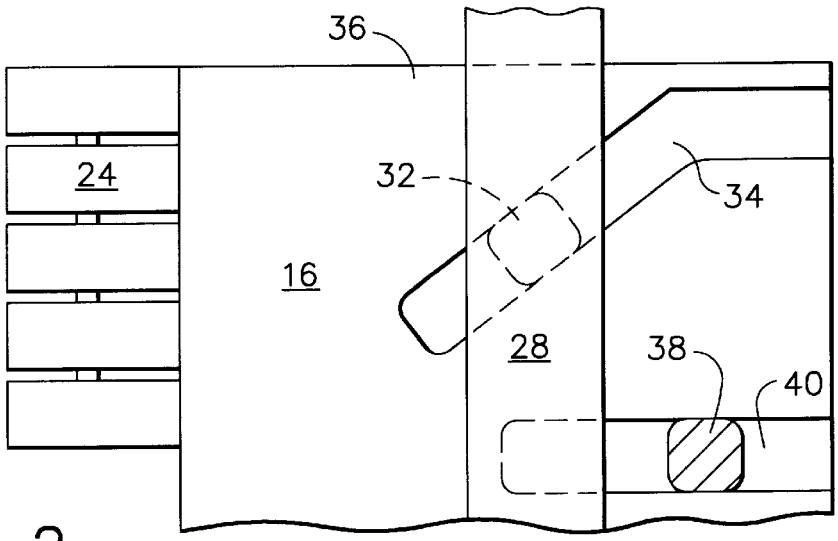
FIG. 2 is a cut away top view of the variable nozzle turbine of FIG. 1 illustrating the slidable piston.

A rotating ring 28 is disposed concentrically around an outside diameter of the sliding piston 16. The rotating ring 28 is rotatably mounted within a ring chamber 29 of a ring housing 30 that is positioned concentrically around an outside diameter of the rotating ring, and that is attached to the turbine housing 12. The rotating ring 28 includes a driving pin 32 that projects outwardly therefrom and radially inwardly towards the sliding piston 16. The driving pin 32 is placed within a helical slot 34 disposed within a sliding piston outside diameter surface 36. As best illustrated in FIG. 2, the helical slot 34 runs laterally along the piston outside diameter surface 36 to effect axial displacement of the slidable piston 16 by rotational movement of the rotating ring 28 and driving pin 32, as will be discussed more fully below. It is to be understood that the VGT of this invention can be constructed having more than one driving pin extending from the rotating ring, and more than one complementary helical slot disposed within the sliding piston.

Referring still to FIG. 1, the ring housing 30 includes an alignment pin 38 that projects outwardly therefrom and radially inwardly towards the sliding piston 16. The alignment pin 38 is nonmovable and is placed within an axial alignment slot 40 disposed, like the helical slot, within the piston outside diameter surface 36. As best illustrated in FIG. 2, the axial alignment slot 40 runs axially along the piston outside diameter surface 36 to both guide axial displacement of the slidable piston 16, caused by interaction of the driving ring driving pin 32 within the helical slot 34, and prevent rotational movement of the slidable piston 16 as discussed in detail subsequently . It is to be understood that the VGT of this invention is alternatively constructed having more than one alignment pin extending from the ring housing, and more than one complementary axial alignment slot disposed within the sliding piston.

Figure 3:
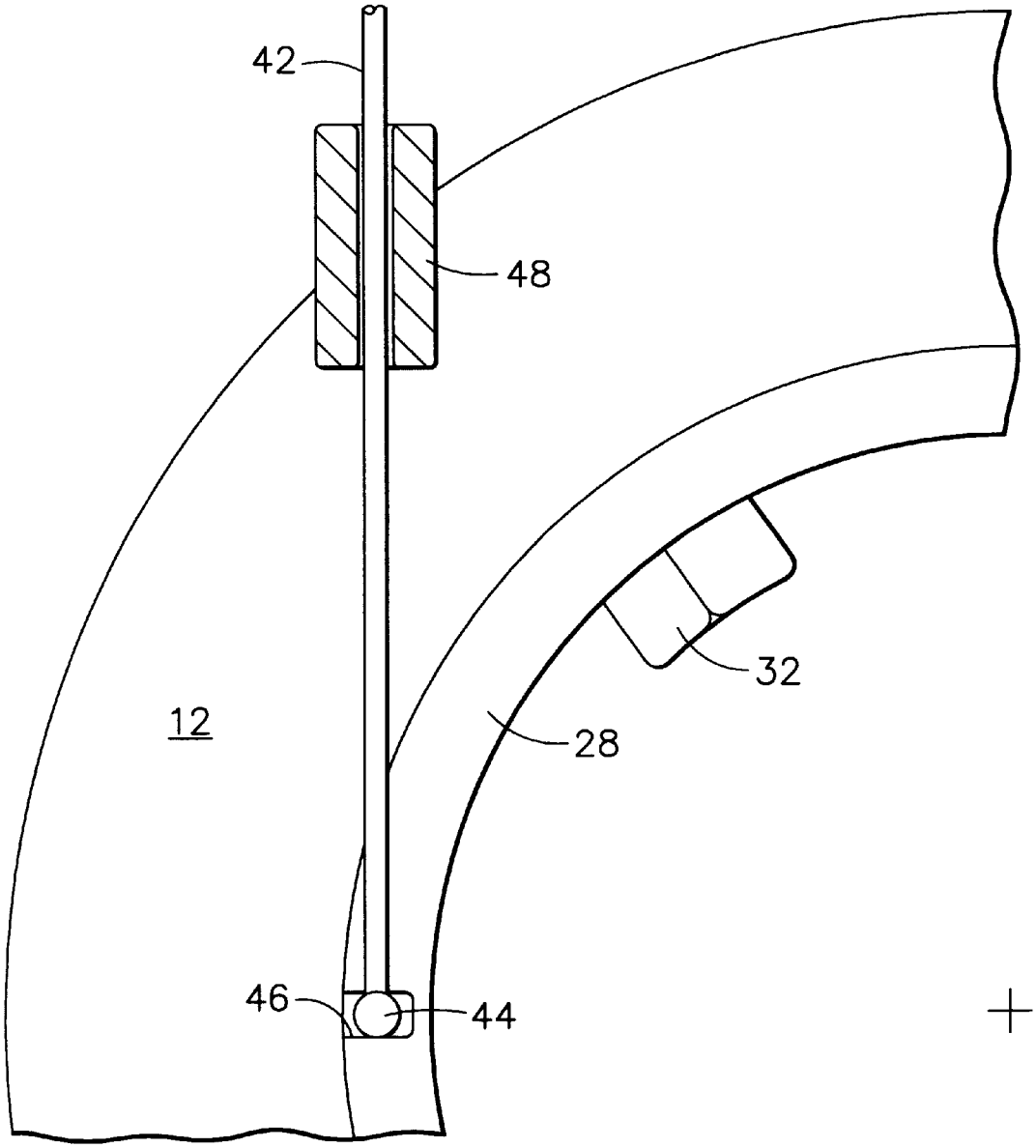
FIG. 3 is a rear view partial view of the variable nozzle turbine of FIG. 1 illustrating an actuating means.

Referring to FIG. 3, the sliding piston 16 is operated to slide axially within the turbine housing 12 by an actuator 42 that is attached to the rotating ring 28. The actuator 42 is preferably in the form of a rod that is attached at one end to the rotating ring 28 via conventional attachment means,. In a preferred embodiment, the attachment means is in the form of a pin and slot assembly comprising an actuating pin 44, extending from the end of the actuating rod 42, and an actuating slot 46 disposed along an outside diameter surface of the rotating ring 28. The actuating rod 42 gains access to the rotating ring via a rod opening through the rotating ring housing or, alternatively, by using a noncontinuous rotating ring housing. At least a portion of the actuating rod 42 is slidably disposed within a guide bushing 48, that is attached to the turbine housing, for guiding displacement of the actuating rod therein.

Materials useful for constructing the turbine housing, turbine, slidable piston, rotating ring, rotating ring housing, drive and alignment pins include materials that are capable of providing the desired mechanical properties at turbocharger operating temperatures and conditions, including metals, metal alloys, ceramic material, ceramic metallic materials, and composites.

Configured in this manner, VGTs employing this invention are operated to increase or decrease the volumetric flowrate of exhaust gas to the turbine by moving the reciprocating actuator in or out, respectively. Moving the actuator rod 42 inwardly relative to the housing 12 causes the rotating ring 28 to be rotated in a counter-clockwise direction within the housing, also causing the driving pin 32 to move downwardly in FIG. 2 within the helical slot 34. The downward movement of the driving pin 32 within the helical slot 34 causes the sliding piston 16 to move axially to the right in FIG. 2, thereby causing the sliding piston 16 to move out of the exhaust gas channel 22 to increase the volumetric flowrate of exhaust gas to the turbine. Conversely, moving the actuator rod 42 outwardly relative to the housing 12 causes the rotating ring 28 to be rotated in a clockwise direction within the housing, also causing the driving pin 32 to move upwardly in FIG. 2 within the helical slot 34. The upward movement of the driving pin 32 within the helical slot 34 causes the sliding piston 16 to move axially to the left in FIG. 2, thereby causing the sliding piston to move into the exhaust gas channel 22 to decrease the volumetric flowrate of exhaust gas to the turbine. In each instance, interaction of the alignment pin 38 within the sliding piston axial alignment slot 40 serves to both guide the axial displacement of the sliding piston and prevent rotary displacement of the sliding piston within the housing.

The turbocharger turbine housing, sliding piston, rotating ring, and rotating ring housing are attached together in the manner disclosed and are combined with other parts conventionally associated with turbochargers to provide a turbocharger for internal combustion engines that incorporates an adjustable exhaust-gas flow path assembly. A feature of this invention is that the slidable displacement of the sliding piston is achieved using a relatively simple operating mechanism and actuating assembly that affords improved turbocharger operating efficiency and service life.

Having now described the invention in detail as required by the patent statutes, those skilled in the art will recognize modifications and substitutions to the specific embodiments disclosed herein. Such modifications are within the scope and intent of the present invention.

What is claimed is:

1. A turbocharger for internal combustion engines comprising:

a turbine housing having an exhaust-gas volute and ar exhaust-gas flow path in communication with the volute and extending radially inwardly into the housing;

an exhaust-gas turbine rotatably mounted within the housing and in gas flow communication with the exhaust gas flow path;

a sliding piston disposed concentrically within the housing having at least a portion thereof positioned within the exhaust gas flow path, the sliding piston including:

a helical slot extending laterally along a piston outside diameter surface; and an alignment slot extending axially along the piston outside diameter surface;

a ring housing fixedly attached to an outside surface of the housing and having a ring groove along an inside diameter surface, the ring housing including an alignment pin projecting outwardly therefrom towards the sliding piston and disposed within the alignment slot;

a rotating ring extending concentrically around the outside diameter surface of the sliding piston and disposed within the ring groove, the rotating ring having a driving pin projecting outwardly therefrom towards the sliding piston and disposed within the alignment slot; and actuating means for rotating the rotating ring within the turbine housing, wherein said rotating causes the sliding piston to be moved axially within the turbine housing by engagement of the driving pin within the helical slot to regulate exhaust gas flow through the exhaust gas flow path, and wherein rotation of the sliding piston within the turbine housing is prevented during said rotating by engagement of the alignment pin within the alignment slot.

2. The turbocharger as described in claim 1 wherein the actuating means is an actuating rod that is slidably attached to the turbine housing, the actuating rod having an end that is attached to the rotating ring, the actuating rod providing rotating displacement of the rotating ring within the turbine housing by reciprocating actuating rod movement.

* * * * *